United States Patent [19]

Bender

[11] 4,050,599

[45] Sept. 27, 1977

[54] APPARATUS FOR ANGULATING FORKS ON A FORK LIFT TRUCK

[76] Inventor: Frank N. Bender, P.O. Box 11430, Reno, Nev. 89510

[21] Appl. No.: 666,698

[22] Filed: Mar. 15, 1976

Related U.S. Application Data

[63] Continuation-in-part of Ser. No. 563,773, March 31, 1975, abandoned.

[51] Int. Cl.[2] ..... B66F 9/14

[52] U.S. Cl. ..... 214/730; 214/750

[58] Field of Search ..... 214/730, 731, 750, 660

[56] References Cited

U.S. PATENT DOCUMENTS

| | | | |
|---|---|---|---|
| 2,271,624 | 2/1942 | Cochran | 214/731 |
| 2,605,918 | 8/1952 | Roscoe | 214/731 |
| 2,643,784 | 6/1953 | Turner et al. | 214/731 |
| 2,706,062 | 4/1955 | Turner et al. | 214/730 |
| 2,774,498 | 12/1956 | Cordes et al. | 214/731 |
| 3,762,588 | 10/1973 | Hansen et al. | 214/730 |

*Primary Examiner*—Lawrence J. Oresky
*Attorney, Agent, or Firm*—Herbert C. Schulze

[57] ABSTRACT

This invention is a new and improved method and attachment for fork lift trucks, providing for greater maneuverability wherein the forks of a fork lift truck are angulated with respect to the direction of travel of the fork lift truck; and wherein the apparatus is distinguished by an attachment which replaces the forks of the fork lift truck on the fork carrier which attachment provides an independent fork carrier as a part thereof and wherein the independent fork carrier is angularly movable with respect to the original fork carrier by use of remote control. Included is the use of a double action cylinder and also a carrier for rolls of carpet.

4 Claims, 15 Drawing Figures

APPARATUS FOR ANGULATING FORKS ON A FORK LIFT TRUCK

CROSS REFERENCE TO RELATED PATENT APPLICATIONS

This application is a continuation in part of application Ser. No. 563,773, filed Mar. 31, 1975 for METHOD AND APPARATUS FOR ANGULATING FORKS ON A FORK LIFT TRUCK, now abandoned.

BACKGROUND OF THE INVENTION

1. Field of the Invention

This invention is in the general field of fork lift trucks, and is more particularly directed to an attachment to the fork carriers wherein the forks are carried by the attachment, and which attachment is so constructed as to provide for a pivoting, or angulation of the forks with relation to the direction of travel of the fork lift truck. The attachment also provides for carrying rolls of carpet.

2. Description of the Prior Art

The prior art with relation to attachments or means for altering the relationship of the forks of a fork lift truck with respect to the direction of travel are limited to a fork lift truck wherein the fork lift truck itself is articulated, normally between the mast and the power unit in such manner in that the entire mast may be angulated with reference to the power unit, or, wherein by a means called "side shifting", the forks of a lift truck may be shifted with respect to the power unit but only in such instances shifted in a manner such that their location with respect to the power unit may be changed during operation, but their angular relationship to the power unit is not changed. There is no prior art in an attachment to the normal fork carrier wherein the angular relationship of the forks to the fork carrier may be altered during operation and remotely.

SUMMARY OF THE INVENTION

One of the most widely used industrial vehicles is a device referred to as a "fork lift truck". Fork lift trucks are known to those skilled in the art and are widely used in virtually every industry where any material must be moved. Frequently fork lift trucks are used for lifting and moving loads of material which are stored upon pallets, and wherein the forks of the fork lift truck are inserted into openings in the pallet for lifting the entire load.

Particularly in warehouses, but in many other places as well, it is frequently difficult properly to align the forks of a fork lift truck with a pallet due to an angular displacement of the pallets with relation to the ability of the fork lift truck to approach them, which often occurs. It is thus frequently necessary for a fork lift truck to approach on an angle with relation to its normal traffic lane or to engage in complex manuvering properly to engage, and lift a load. Also, in close work, it is frequently difficult to turn a corner, or the like, with the load protruding directly from the front of the fork lift truck.

In the past, some very expensive fork lift trucks have been available wherein the mast of the truck is articulated with relation to the truck itself in such manner that there can be an angular relationship established between the entire mast and the forks it carries and the truck. Such alterations have the disadvantages of greatly increased cost of the fork lift truck and increased length of the truck, which, to a large extent, offsets the advantage achieved by the possibility of angulation of the forks with relation to the truck.

We have studied this problem and have conceived and developed a new, improved, and unique attachment for fork lift trucks which makes it possible, economically, to convert any fork lift truck to a truck having an angulated fork capability. We have accomplished this by providing a special carrier to attach to the normal fork carrier in place of the fork, which carrier carries a secondary fork carrier and which is so mounted on the adapter as to be angularly displaceable with relation to the original fork carrier.

With the forks loaded upon the auxiliary, or secondary, fork carrier, the adapter can be maneuvered so as to provide angular relationship between the forks and the truck itself. This is normally accomplished by the use of a remotely controlled hydraulic cylinder or the like, the activation unit for which is operable by the driver of the vehicle.

We have developed this attachment in one form, basically rotatable, wherein the forks always maintain a constant relationship with regard to one another regardless of angulation; In another embodiment wherein the forks, while remaining parallel, change their relationship to one another during the angulation; and in other embodiments as described. Additionally, we have an attachment for carrying rolls of carpet, or the like.

It is an object of this invention to provide an attachment for fork lift trucks by which the forks may be angulated with reference to the truck;

Another object of this invention is to provide such a device as above mentioned wherein the forks maintain a constant relationship to one another during angulation;

Another object of this invention is to provide such a device as above described wherein the relationship of the forks to one another may change during angulation.

Another object of this invention is to provide a method for increasing the maneuverability of fork lift trucks by angulation of the forks.

The foregoing and other objects and advantages of this invention will be clear to those skilled in the art upon reading the following description of a preferred embodiment in conjunction with a review of the appended drawings.

Figure 4:
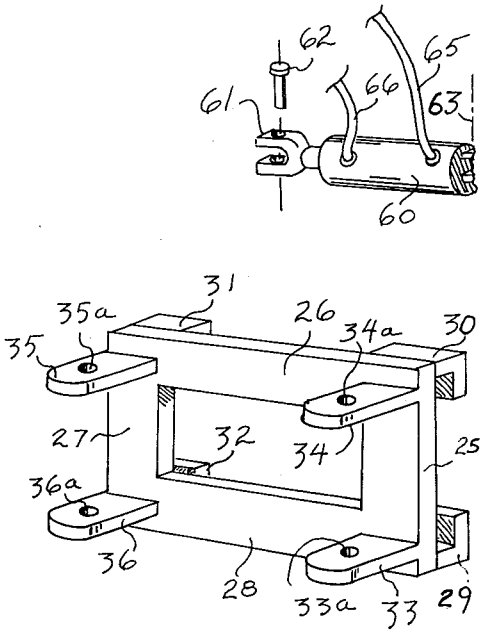
FIG. 4 is an exploded view of the parts of the device of this invention shown in FIG. 2.

FIG. **4*a* is a perspective of an alternative embodiment of a portion of the device of FIG. 4;**

Figure 5:
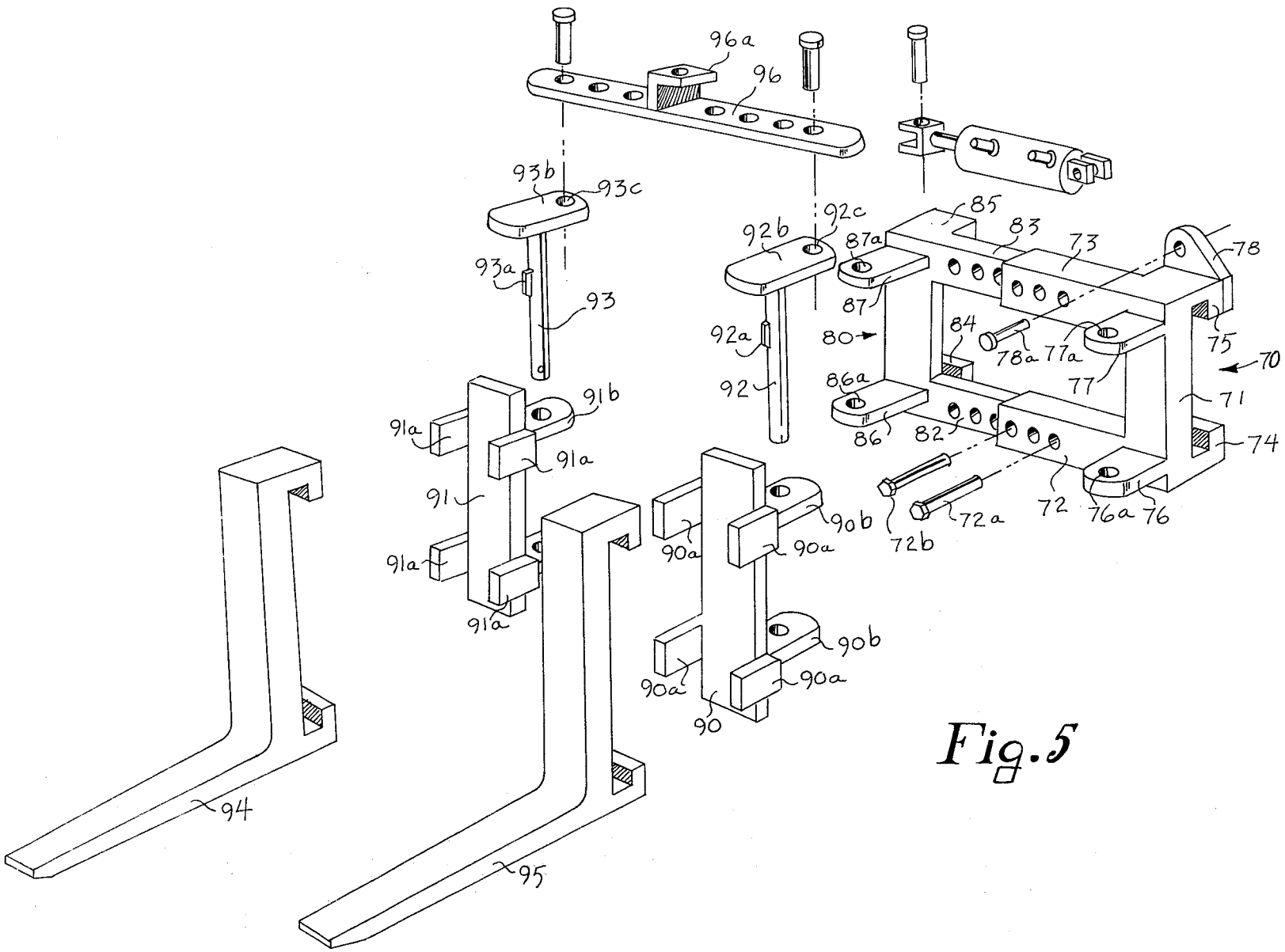
Figure 6:
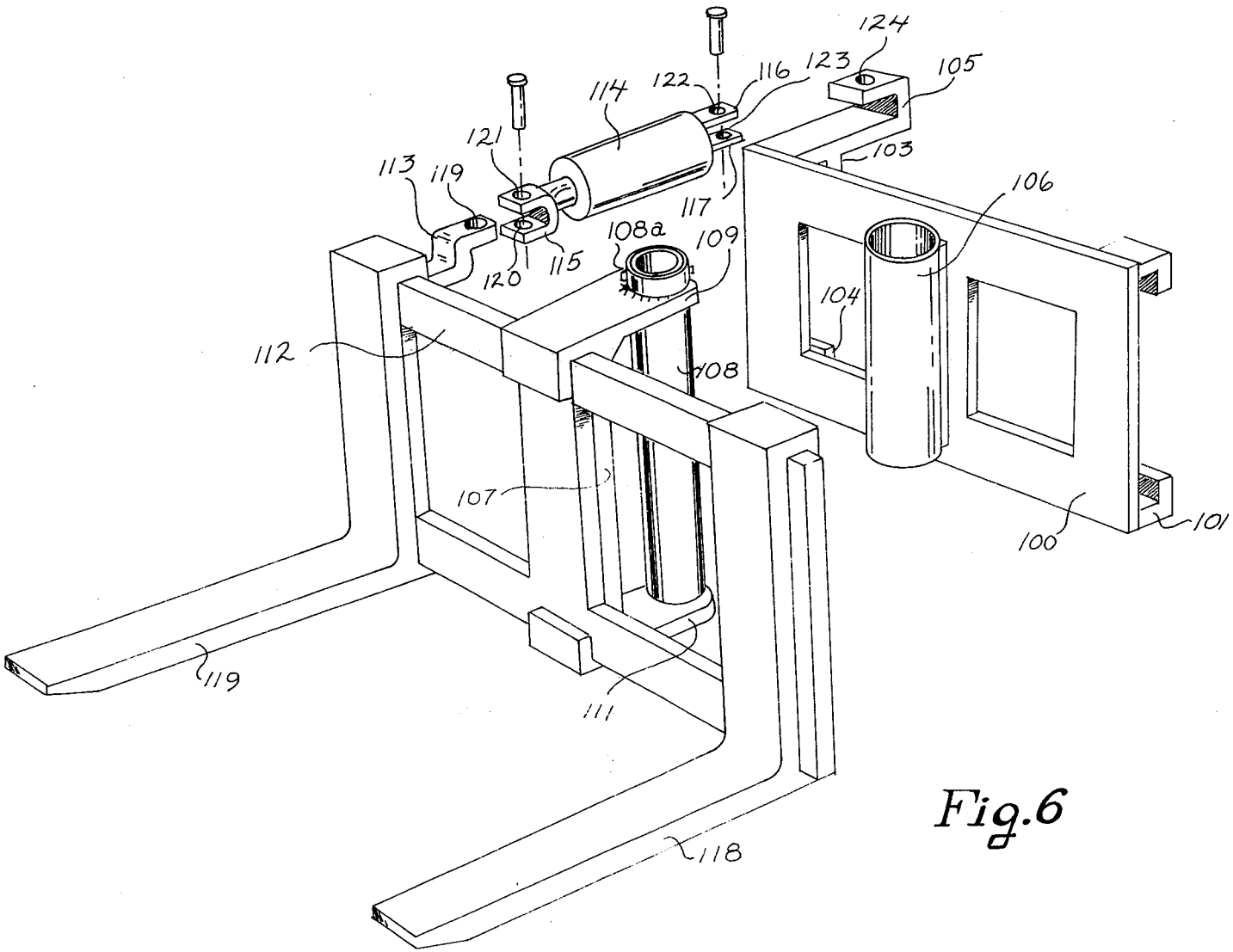
Figure 7:
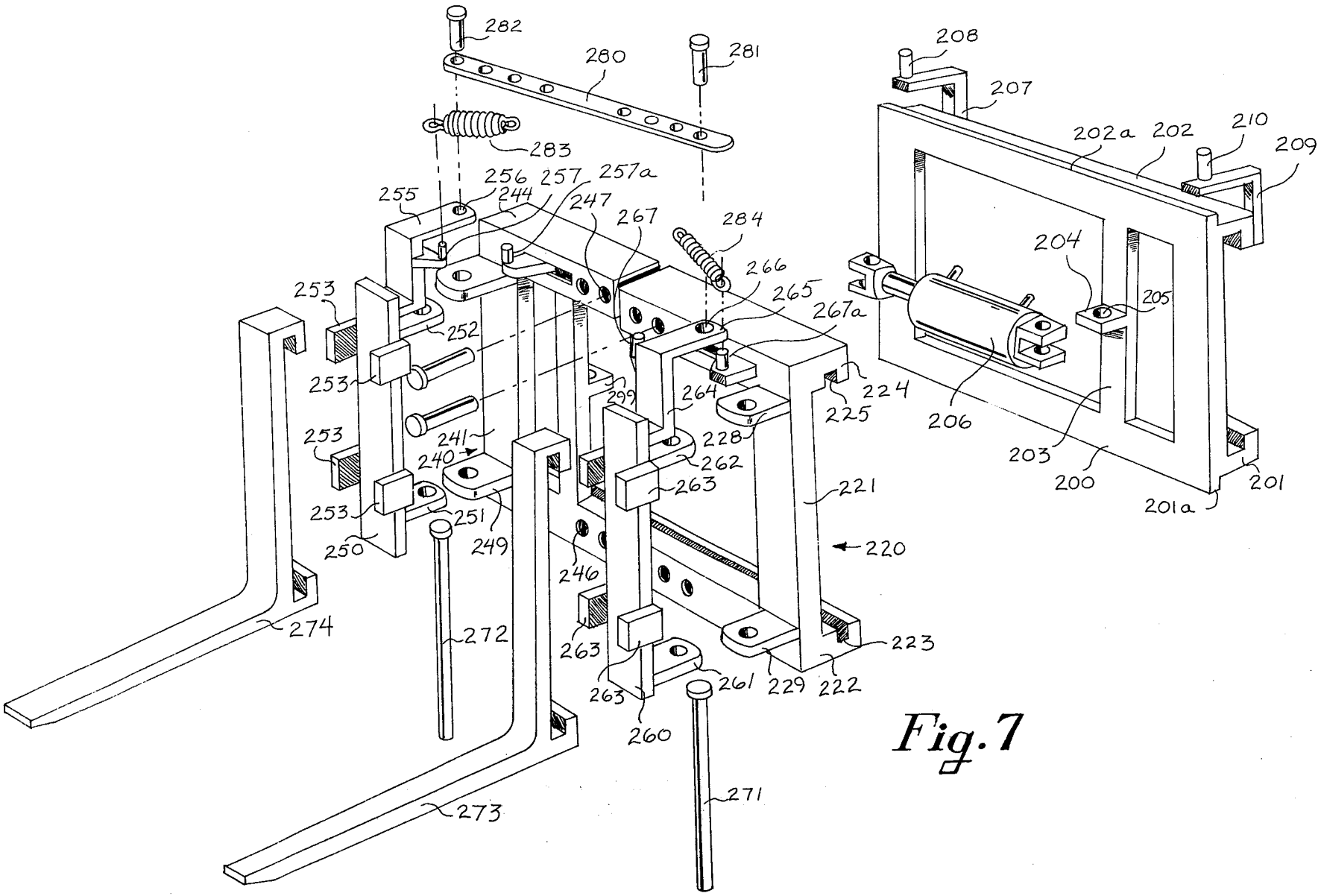
Figure 8:
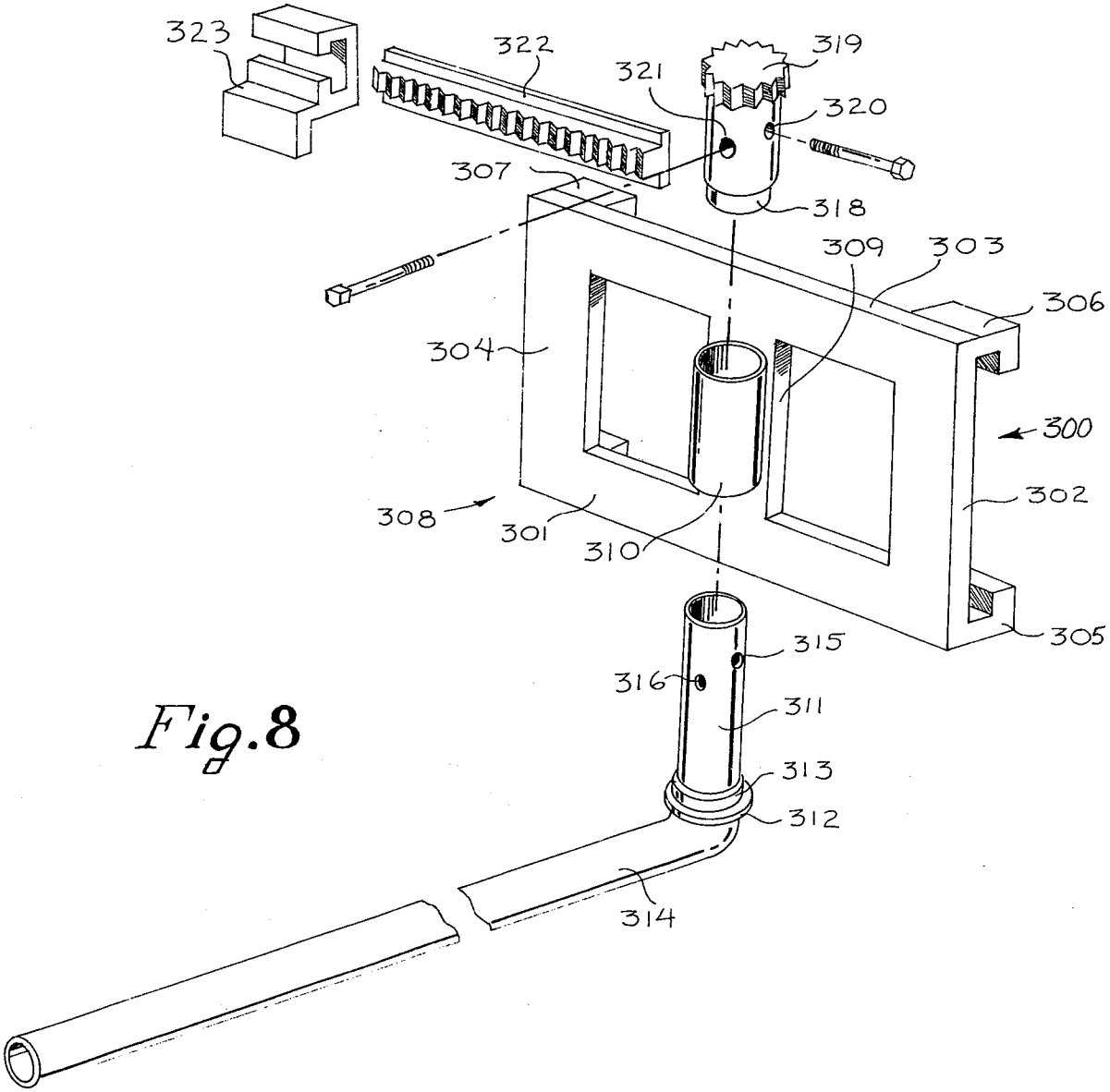
Figures 9, 10:
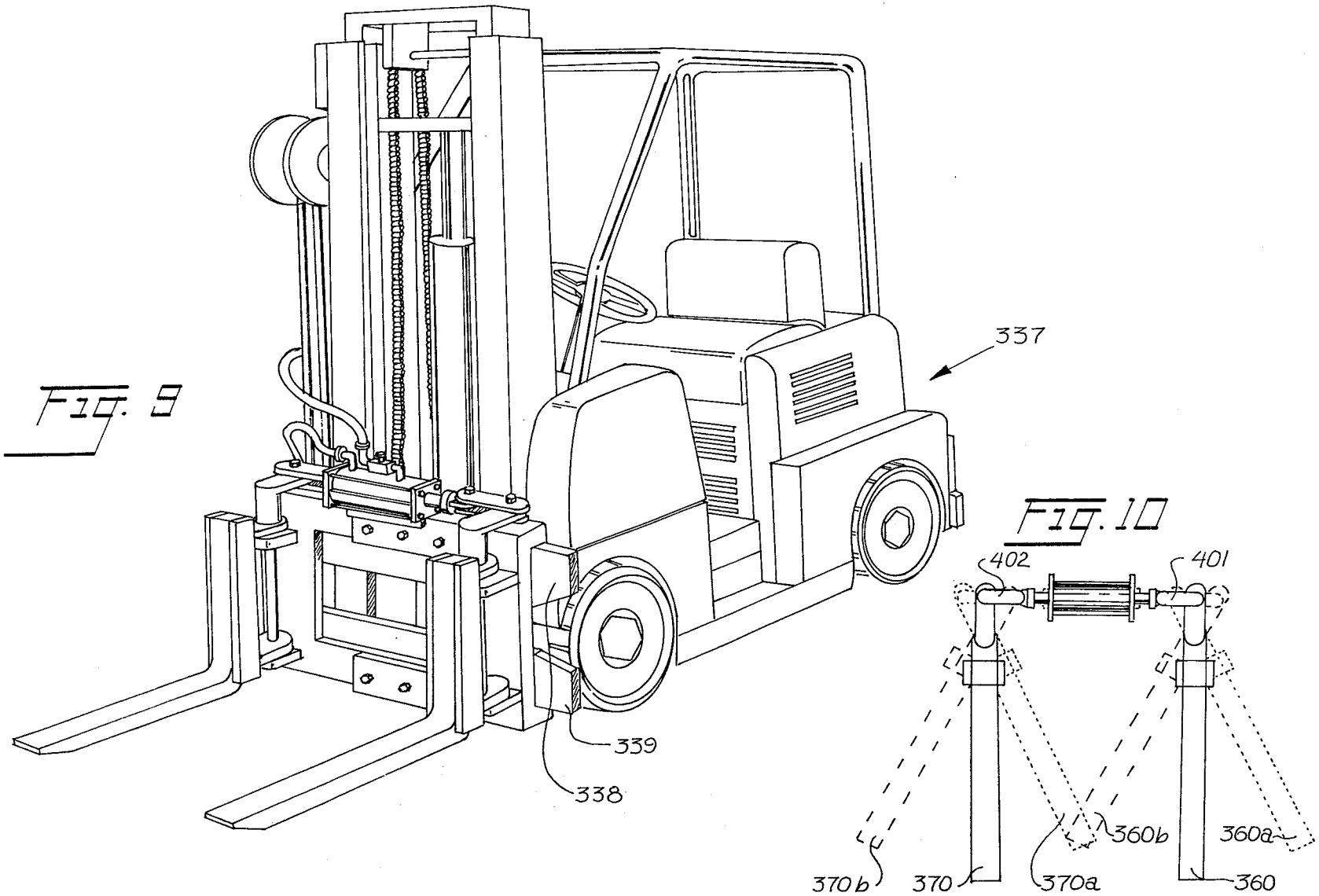
Figures 11, 11A:
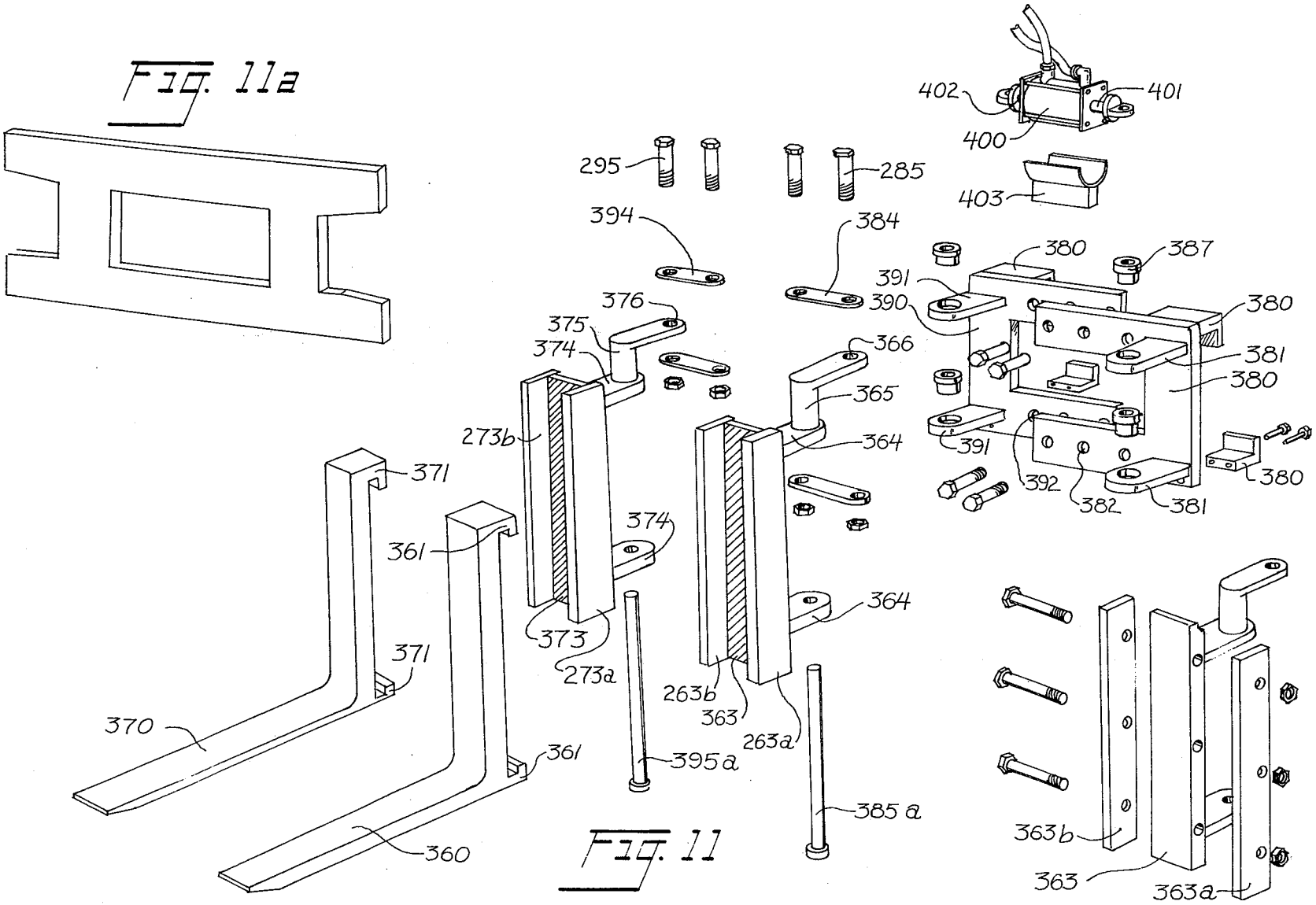
Figure 11B:
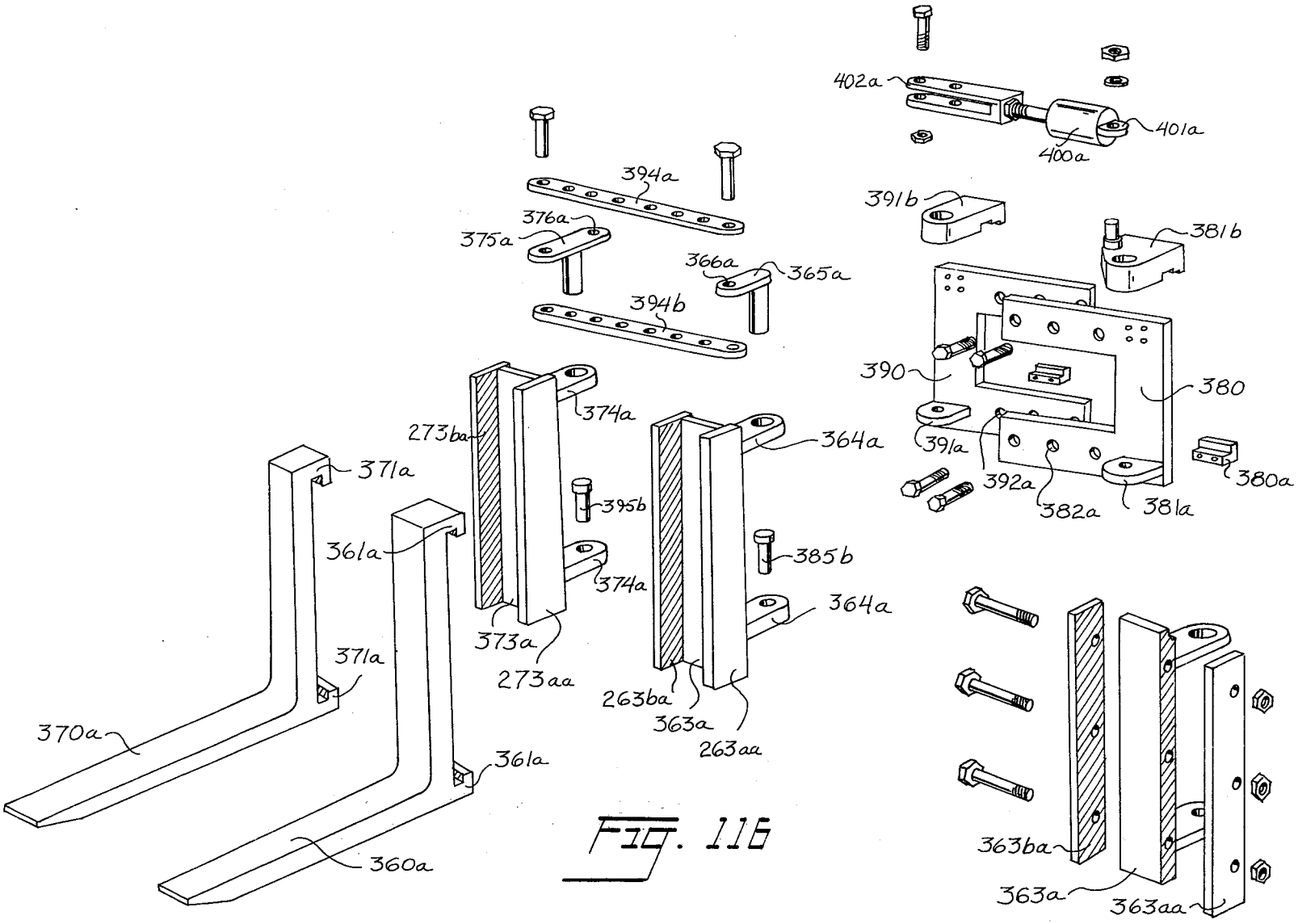
Figure 12:
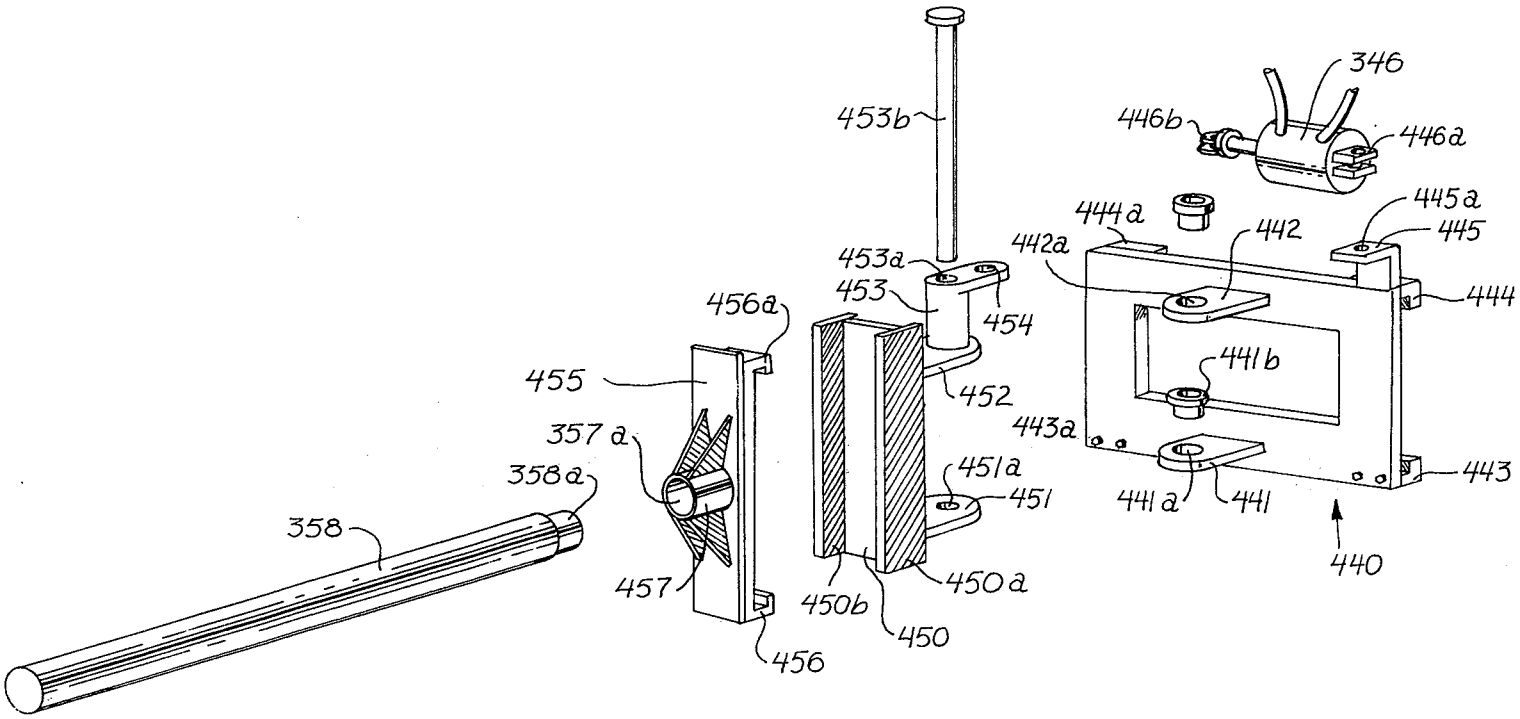

FIG. 5 is an exploded view of an alternative embodiment of the device as shown in FIG. 4;

FIG. 6 is a partially exploded perspective view of another embodiment of a device of this invention;

FIG. 7 is another alternative embodiment shown in partially exploded perspective view, which embodiment is specifically adapted to a type of lift truck known as a "side shifter";

FIG. 8 is an exploded perspective view of an alternative pivoting and carrying arrangement to be utilized with the basic carrier of FIG. 6;

FIG. 9 is a perspective view of a fork lift truck carrying one embodiment of the device of this invention;

FIG. 10 is a reduced scale schematic of the forks being angulated;

FIG. 11 is an exploded view of an embodiment of the device of this invention;

FIGS. 11*a* and 11*b* are perspective views of an alternative embodiment of elements of the device of FIG. 11; and FIG. 12 is an exploded view of an embodiment of an alternative pivoting arrangement.

DESCRIPTION OF A PREFERRED EMBODIMENT

Figure 1:
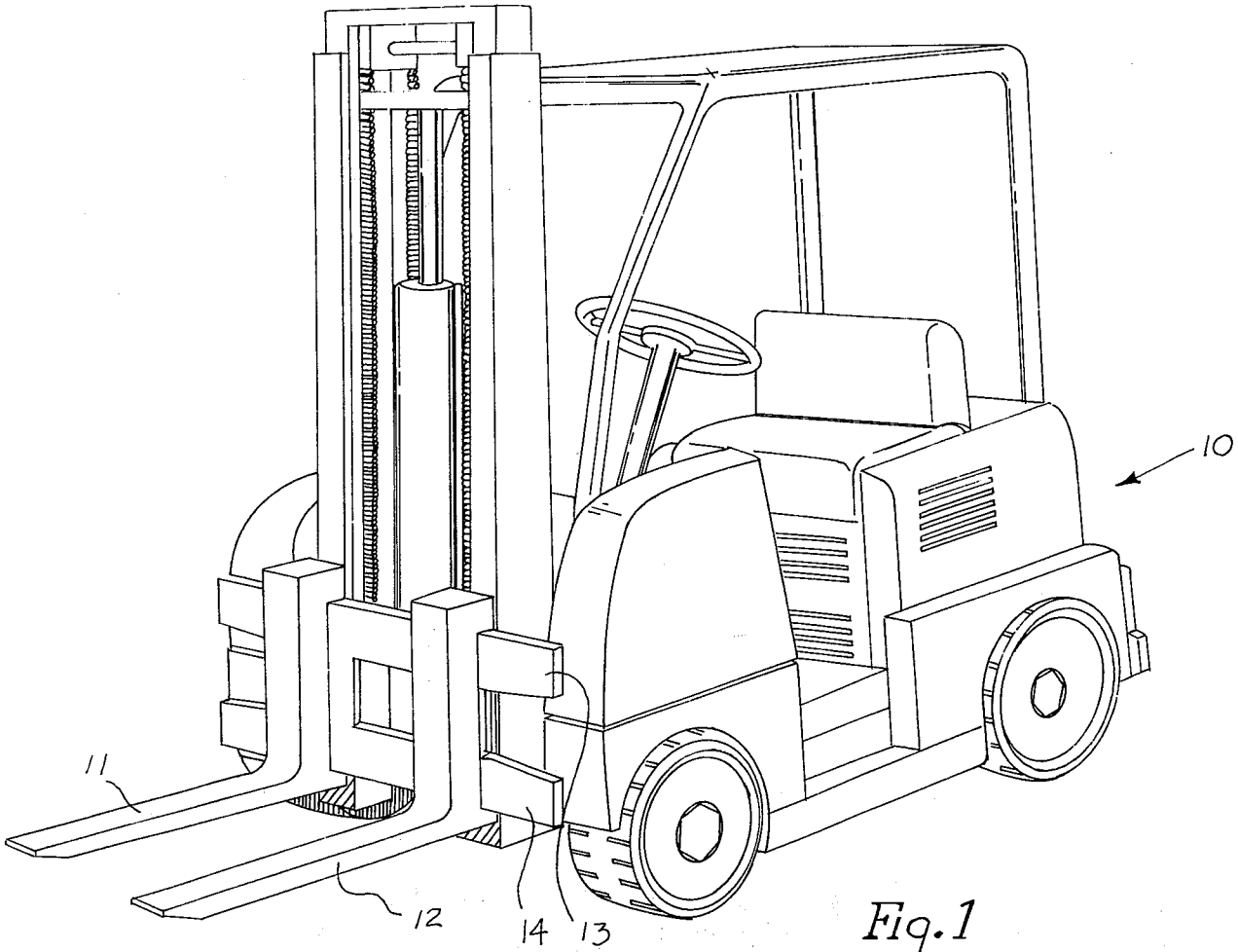
FIG. 1 is a perspective view of a customary fork lift truck.

With attention directed particularly to FIG. 1, there is shown a customary lift truck 10 being provided with two forks 11 and 12, which are carried by fork carrier 13, which in turn is activated upwardly and downwardly and in certain degrees of tilt by mechanism as is known to those skilled in the art.

Figures 2, 3:
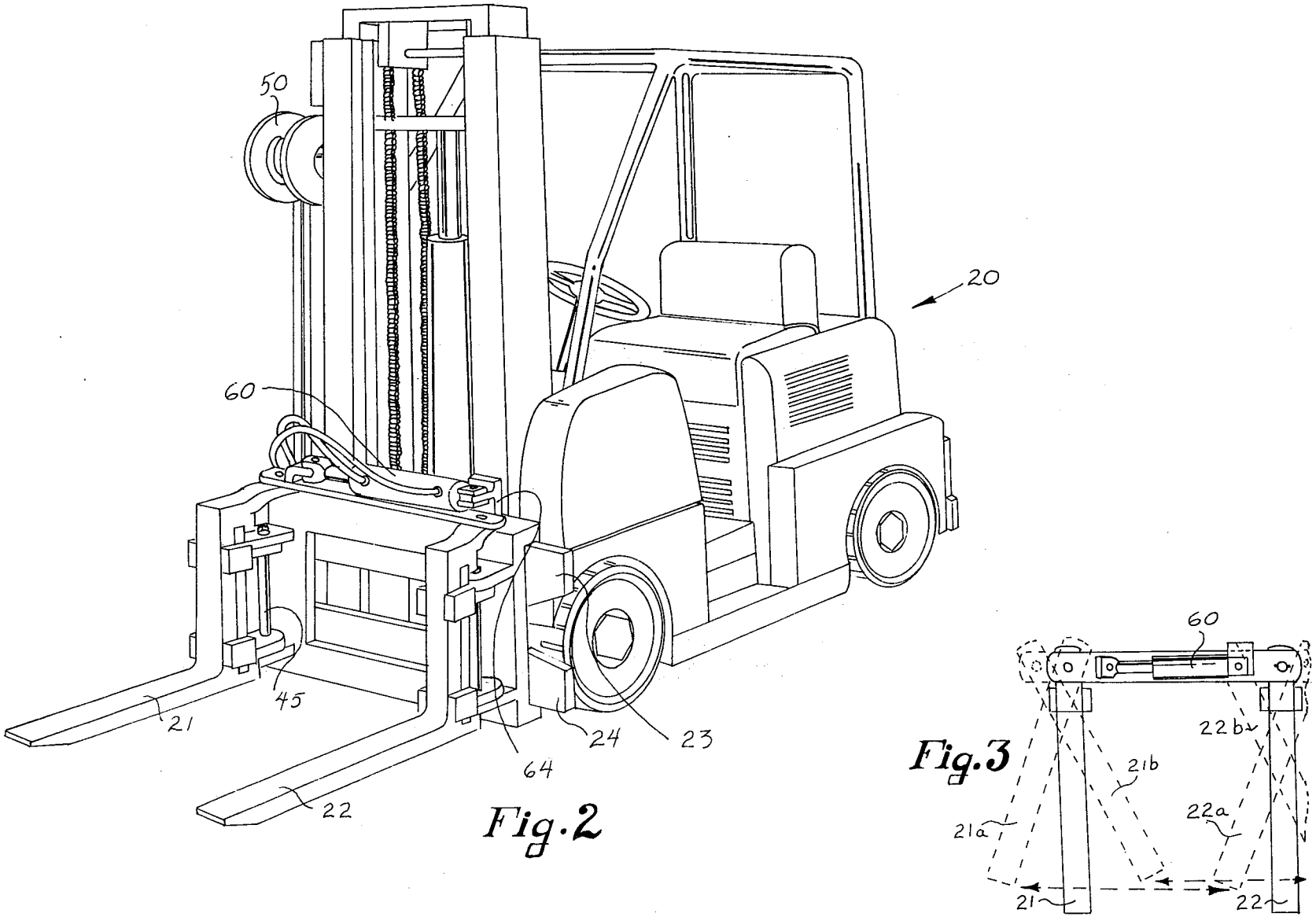
FIG. 2 is a perspective view of a fork lift truck of the type generally shown in FIG. 1 carrying one embodiment of the device of this invention.
FIG. 3 is a schematic reduced scale representation of the forks showing their angulation positions.

FIG. 2 illustrates a lift truck of essentially the same general design as the lift truck of FIG. 1, but wherein the truck has been modified so as to utilize and carry the particular embodiment of this invention therein shown.

In FIG. 2 there is illustrated the lift truck generally 20, having carrier for the forks consisting of carrier elements 23 and 24, and having customary forks 21 and 22, but which have been modified, to be utilized with this invention. It will be noted that in addition to the adapter frame shown in FIG. 2 and the other elements of the device as will be more particularly described in connection with FIG. 4, that there is a reel 50 of customary type for handling the hydraulic hoses from the special hydraulic cylinder 60 which activates the angulation as will be hereinafter described.

There is a lever available to the driver (not shown) which activates valving of customary hydraulic nature to cause the hydraulic cylinder to be activated backwards and forwards.

The forks 21 and 22 have been especially altered by having welded at the top thereof, or otherwise fastened thereto, the swivel activating arms 21*a* and 22*a* respectively. These arms each have a hole at 21*b* and 22*b* as indicated, which is suitable to be engaged by pins 42 and 43 respectively and into holes 39 and 38 of arm 37. Arm 37 is provided with a bracket 40 having a hole 41 suitable to be engaged by the end clevis 61 of the rod of hydraulic cylinder 60 and held in place by pin 62 in customary manner. The clevis 63 on the other end of cylinder 60 is fastened by a pin or the like to bracket 64, again in manner customary in the art.

Fork holding bars 48 and 49 are provided in such manner that the fork may be mounted upon them as though they were upon the original fork carrier, but these bars are provided with elements 46, 47, 51 and 52 as indicated, by welding or the like. Through the appropriate holes 46*a*, 47*a*, 51*a*, and 52*a*, pins 44 and 45 will hold these elements in pivotal mounting on the elements 33, 34, 35, and 36 in a manner which will be clear to those skilled in the art, by being inserted through the holes 33*a*, 34*a*, 35*a*, and 36*a*. The brackets 33, 34, 35, and 36, are seen to be fastened to a frame consisting of elements 25, 26, 27 and 28 welded together in a rectangular form as shown, or other suitable mounting plate. Such plate, on its other side, is provided with the generally "L" shaped brackets 29, 30, 31, and 32 which are mounted upon the fork carrier 23 and 24.

It will now be clear to those skilled in the art that if the hydraulic cylinder is mounted in such manner that when the rod is half extended, the forks are parallel, as shown in FIG. 2, that upon retracting the rod, the forks will swing so that they assume the positions of 21*a* and 22*a* as shown in FIG. 3, and when extended the forks will swing in the other direction as indicated in 21*b* and 22*b* of FIG. 3. Thus, as an operator wishes to pick up a load at an angular relationship to the fork truck he may do so by angulating the forks appropriately. Also, in rounding a corner where there is little space, by angulating the load in front of the truck, the effect is to make a much shorter turning radius.

In FIG. 5 there is illustrated an alternate embodiment of the device of FIG. 4. In this case, the principal difference is that the carrier for the angulatable forks is now so designed that it may be adjusted in width thus bringing the forks closer together or spreading them farther apart. The two forks 94 and 95 hang upon their carriers 91 and 90 respectively in the same general manner as the embodiment shown in FIG. 4. In this case it will be noted that the extensions for the pivoting, 21*a* and 22*a* of FIG. 4 are not utilized. In this case the pivoting takes place in a different manner by utilization of the pivot point arrangements 92 and 93 and their associated devices which will be described further.

It will be noted that preferably the carriers 90 and 91 will be supplied with a plurality of guide members 90*a* and 91*a* respectively to maintain the forks in position.

The carrier members 90 and 91 have two tabs 90*b* and 91*b* respectively welded or otherwise fastened thereon in the position indicated. These tabs have holes (unnumbered) as indicated, and the hole in the upper tab in each case is noted to have a keyway provided therein.

The pivot pins 92 and 93 are so adapted as to extend through the holes both in the tabs 90*b* and 91*b* and in the tabs from the fix 77, 86, and 87 in the matching same members which will be described below.

It will be noted that each of the pins 92 and 93 has a key 92*a* and 93*a* respectively which is so positioned as to engage in the keyway in the hole on tabs 90*b* and 91*b*. The plate 92*b* and the plate 93*b* are welded or otherwise fixed to the tops of the pins and these plates are each provided with a hole 92*c* and 93*c* respectively which holes are so adapted to be capable of being aligned under corresponding holes in activation member 96. It will be noted that there are several holes to accommodate for the adjustment of the forks in the positions closer or farther apart from one another. The activation arm 96 carries a suitable bracket or the like 96*a* to be engaged by the clevis and pin (unnumbered) on the end of the hydraulic cylinder (shown but not numbered). The other end of the hydraulic cylinder will be engaged by an appropriate clevice pin arrangement by the member 78 and pin 73*a* inserted through the hole in member 78.

It will be noted that the pivot brackets 77 and 87 are provided with holes 77*a* and 87*a*, each of which has been shown with a keyway. It is to be understood that this keyway is not engaged by the key on the respective pivot pin since the tab 91*b* will slip beneath the tab 87 and the tab 90*b* will slip beneath the tab 77. The reason for this keyway is to enable the keys 92*a* and 93*a* on the pivot pins to be permanently affixed therein if desired in position to activate the members 91 and 90, and yet so adapted as to be insertible from the top through the hole in tab 87*a* and 77*a* respectively.

The two frame members which hang upon the normal fork carrier of the fork lift truck 70 and 80 generally are each essentially a U-shaped member consisting of the members 71, 72 and 73, and 81, 82 and 83. In each case, tracks suitable to engage the fork carriers 74, 75, 84, and 85 are appropriately provided as will be clear to those skilled in the art. The members 72, 82, 73 and 83 carry a series of holes and these holes will be aligned and the frames fastened together by bolts or the like 72*a* and 72*b.* A similar pair of bolts will be provided for the upper series of holes in members 73 and 83, but they have not been shown for purposes of clarity in the drawing.

It will now become apparent to those skilled in the art, in the embodiment shown in FIG. 5 the basic carrier 70–80 will be appropriately fastened together in the space apart relationship desired, the hydraulic cylinder will be fastened into position on the tab 78 and the activation arm 96 will be engaged by the other end of the hydraulic cylinder. It will be clear that the two ports of the hydraulic will be appropriately connected to a source of hydraulic fluid and that there will be controls customary in the art to allow the expansion of the rod or the retraction of the rod.

The member 96 will be fastened to the plates 92*b* and 93*b* by pins through appropriate holes in alignment dependent upon the spacing of the carrier 70–80.

Thus, when the hydraulic cylinder is activated in one direction, the forks will angulate in the opposite direction as will be clear, since the fork carriers 90 and 91 will be turned by the engagement of the keys 92*a* and 93*a* in the keyway in the holes within the members 90*b* and 91*b,* respectively.

Attention should now be directed to the embodiment shown in FIG. 6, which might be considered the most desirable embodiment in many respects. In this case, there is a frame 100 which could be formed of one plate, or as illustrated, from a number of plates welded or otherwise fastened together to provide the frame generally as illustrated. This frame has brackets 101, 102, 103, and 104 fixed thereto, for the purpose of mounting upon the fork carrier 23–24 of FIG. 2. Additionally, the bracket 105 having hole 124 is provided as a mounting bracket for the hydraulic cylinder 114, which is mounted thereon by the clevis arrangement 116, 117 and utilizing a pin which will pass through the holes 122, 123, and 124. The clevis 115 upon the end of the hydraulic cylinder rod will be provided with the two holes 120 and 121 which will cooperate with hole 119 on bracket 113 which is fastened to member 112 of the frame 110 which carries the forks.

A tube or the like 106 is welded or otherwise fixedly attached to the frame 100 essentially as shown, and is so adapted as to be able to engage with a second tube or bar 108 which will be mounted in holes in bracket 109 and 111 by sliding engagement. These brackets are carried by frame 107 in a manner which will be clear to those skilled in the art. A flange, or the like, 108*a* will hold tube 108 with reference to the brackets by being bolted or otherwise fastened to the upper bracket.

The forks 118 and 119 are carried upon the member 112 in the customary manner, since member 112 acts in place of the normal fork carrier of the vehicle.

The main feature of this particular device will become readily apparent when it is seen that in utilizing this device when the hydraulic cylinder 114 is activated, the fork carrier swings through an arc, thus angulating the forks, but maintaining them in their relationship as to width which has been previously fixed.

It will be clear that in the previous embodiments shown that as the forks angulate they will come closer together although retaining their parallel relationship. This of course is particularly desirable in many instances where it is desired to turn sharply about a corner or the like, and the shortening of the distance between the forks further shortens the effective turning radius particularly when there is no load attached or carried by the forks.

FIG. 7 is one more embodiment which has been especially constructed for use in conjunction with a type of lift truck known as a "side shifter". Such lift trucks are known to those skilled in the art, and in such trucks the forks are mounted upon a carrier which carrier is so mounted upon the front of the lift truck that it shifts sideways. Such arrangement, however, does not angulate the forks. It merely shifts the fork carrier to one side or the other with relation to the vehicle.

It has seemed desirable to also add the angulating arrangement to this version, and to this end, the device of FIG. 7 has been constructed. It will be clear that by mounting a carrier which is somewhat similar to the carrier of FIG. 3 as a side shifting device, that by the appropriate positioning of pins and the like, the forks can be made to angulate by side shifting.

The elements basically required in the embodiment of FIG. 7 are a pair of forks 274 and 273 of more or less customary construction, together with fork carriers 260 and 250, preferably having a series of guide members 253 and 263 as shown. The pivot mounting tabs 251 and 252 are so arranged, with holes appropriately positioned, as to cooperate with the mounting brackets 248 and 249 when pin 272 is inserted. Likewise, the mounting member 260 will be supported on members 261 and 262 and in a similar manner cooperate with elements 228 and 229 and mounting pivot pin 271. A pair of brackets, 254 and 264 are shown in position in conjunction with the fork carriers 250 and 260.

While it is not clear due to the angle from which the drawing is made, these brackets will preferably be bolted or otherwise temporarily fastened so that the pins 271 and 272 can be inserted from the top. This, however, is not critical, since the pins can also be inserted from the bottom and held in place with pins or the like.

The two brackets 254 and 264 have elements 255 and 265 depending outwardly therefrom, and each has its respective hole 256 and 266 for purposes of accommodating the pins 282 and 281 which will be utilized to fasten connecting member 280 to these two elements. Springs 283 and 284 are provided and are held by pins 257 and 257*a,* and 267 and 267*a* respectively. These springs are so located for the purpose of returning forks to a parallel position after angulation as will be hereinafter described.

The frame 220–240 is an adjustable type frame similar to the type frame previously described in conjunction with FIG. 5. In this case, the frame 220 comprises a generally U-shaped piece 221 carrying a pair of arms 222 and 224 having suitable varying grooves 223 and 225 to ride upon the guide rail carried upon the lift truck and which will be described below.

The member 240 also has a generally U-shaped frame 241 with appropriate carriers 243 and 244. These elements are fastened together by means of proper alignment of the appropriate desired holes 226–246 and 227–247 and the utilization of bolts or the like (not shown) to fasten the two elements together to make one frame piece.

The frame 200 is a generally rectangular frame having a pair of shoulders 201 and 202 each of which carries a suitable track 201*a* and 202*a* respectively, which track is so adapted as to receive the unitized member 220–240 on the appropriate ways as have been previously described. This frame 200 is connected to the fork lift truck in a manner known to those skilled in the art, and additionally carries the support member 203 with the hydraulic cylinder mounting bracket 204 wherein the hydraulic cylinder is mounted by means of the clevis through hole 205 and an appropriate pin (not shown). The clevis on the rod end of hydraulic cylinder 206 is appropriately connected to bracket 299 through the hole therein and by means of a pin (not shown) by means known to those skilled in the art. While in the particular illustration shown, no hydraulic hoses have been illustrated, it is to be understood that this is only for purposes of clarity of the drawing and there will be two hydraulic hoses on hydraulic cylinder 206 which of course will be activated by appropriate hydraulic fluid means known to those skilled in the art.

It is to be observed that element 200 has attached thereto brackets 207 and 209 carrying respectively pins 208 and 210. These pins are so positioned that when the element 220–240 is shifted sideways that the pins will be contacted by the pressions 255 and 265 of the fork carriers. In this manner, when shifting towards pin 208, the element 255 will be forced against pin 208 and will cause a pivoting of the fork carrier 250 and the fork 274. Because the two forks are tied together by element 280, those forks will thus turn in the opposite direction from the direction of travel of the element 220–240. It will be clear that the process will be reversed when the opposite direction of travel is involved, and when element 265 comes in contact with pin 210.

In each case, the springs 283 and 284 will cause a return of the forks to their original forward position upon the return from contact with the respective pins 208 and 210.

Figure 4A:
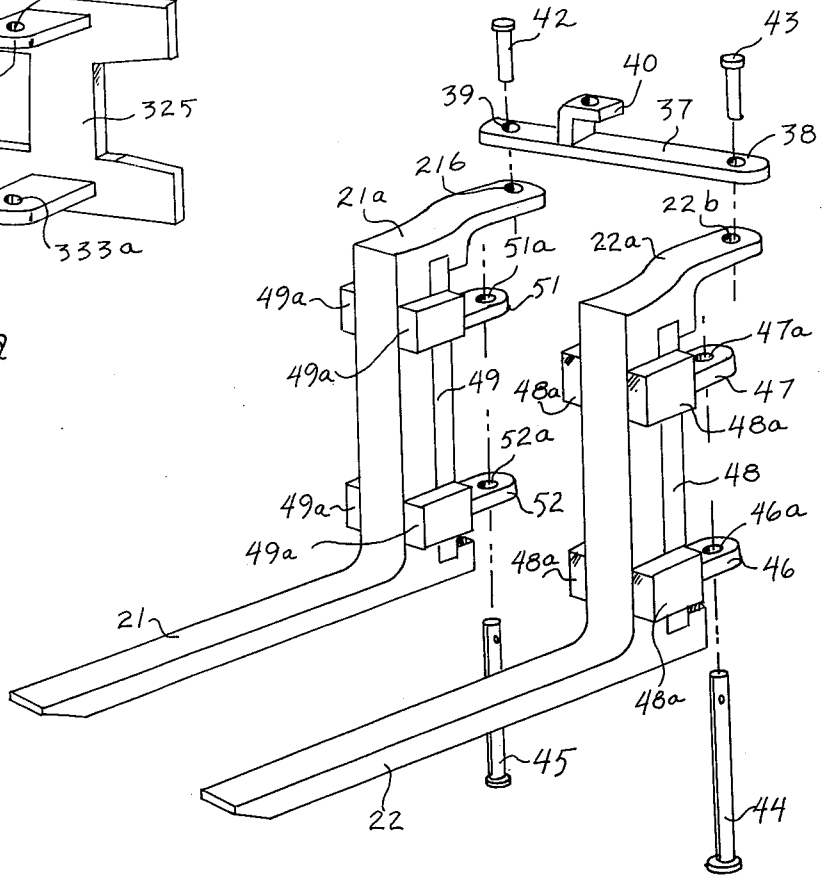
Figure 4A:
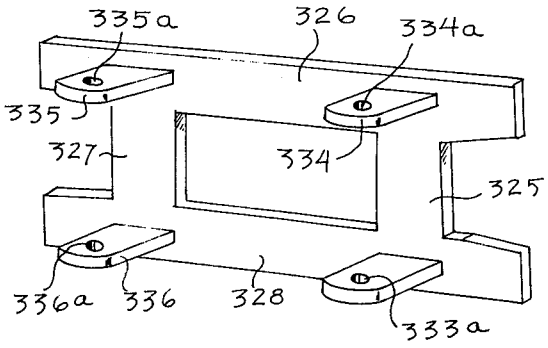

In reading this specification it will be observed that no reference has previously been made to FIG. 4*a.* This has been purposeful, since up to this point the description of the various embodiments has been solely directed to an attachment to add to a fork lift truck adding such attachments onto an existing customary fork carrier. FIG. 4*a* is solely directed to showing one manner in which the fork lift truck may be manufactured with a device to practice the embodiment of this invention as an integral part of the originally manufactured machine.

Examining carefully FIG. 4*a* it will be seen that FIG. 4*a* is designed to show one device which may be manufactured directly as a part of the mast lifting device of the fork truck and otherwise operate with the other elements of FIG. 4.

FIG. 4*a* shows a pair of elements 326 and 328 which will generally correspond to elements 13 and 14 of FIG. 1 and 23 and 24 of FIG. 2. Now, however, instead of having the elements 29, 30, 31 and 32, since these elements are directly attached to the lifting mast, there are only the side braces 325 and 327 together with the pivotal mounting elements 333, 334, 335, and 336, each having the appropriate hole 333*a,* 334*a,* 335*a* and 336*a,* adapted to accommodate the pins 44 and 45 in the same manner as is described previously with reference to the other elements of FIG. 4.

The device of FIG. 4*a,* as will be clear to those skilled in the art, is one manner in which this device could be directly incorporated as a portion of the lifting mechanism and it is not intended that it be limited solely to that embodiment. One skilled in the art will understand how the other embodiments shown and other variations could be used for providing the pivotal mounting directly upon the lifting mast.

Throughout this specification reference has been made to the use of hydraulic cylinders and the like for activation and to certain other elements. It is to be understood that these are for purposes of reference only and elements performing a like function can readily be substituted. For example, it will be clear that those cylinders, gearing and the like, could be used for the activation of the various movable elements rather than hydraulic cylinders. Likewise, other places where appropriate there could be substitute materials and mechanisms.

Considerable reference has been made to a pair of forks, which is quite customary with fork lift trucks. It is also to be understood that various attachments are sometimes carried by a pair of forks, such as an attachment with an elongated member to handle rolls of carpet and the like as is known to those skilled in the art. The embodiment of this invention particularly shown in FIG. 6 will be unusually adapted to such an application, since by attaching such a member, the carpet may be swung in an arc thus reducing the maneuvering space required by the lift truck in such handling. Additionally, it should further be noted that two forks, one fork, or more than two forks could as well be utilized in the various embodiments shown and described and in this method. For example, with reference to FIG. 2, one fork only could be utilized if desired, for example fork 21, and the brackets carrying it could be fastened any place desired upon the fork carrier.

These features are particularly pointed out to make it clear that there is no limitation to a pair of forks as such.

In particular, a very interesting and unique application of widespread value is illustrated in FIG. 8. FIG. 8 illustrates a means by which a virtual one hundred and eighty degree turning may be accomplished with the use of a single member and without any excessive links for the pivoting arrangement. The device shown in FIG. 8 is well adapted for the use of handling rolls of carpet, type, and things of this nature as will be clear to those skilled in the art upon considering the elements.

The basic carrier unit may consist of a frame or the like composed of members such as 301, 302, 303 and 304, with a center member 309. The carrier unit may be carried upon the lift truck fork carriers by the carrier elements 305, 306, 307 and 308 (not visible in this view) in a manner as shown in other embodiments of this invention and as will be understood by those skilled in the art. A tubing or the like 310 will be welded or otherwise affixed to the center brace member 309. A piece of tubing or the like 311 suitable to be inserted within the tubing 309 will carry at its lower portion a flange 312 with a shoulder 311 for bearing purposes within the tubing 310. An extension 314 of any desired length will be affixed as indicated. A pair of holes 315 and 316, or the like, will be provided to receive bolts or the like (not shown) and to connect to holes 320 and 321 in upper sleeve 317. The upper sleeve 317 is so adapted that the shoulder bearing portion 318 is of the same diameter as 313. When the tubing 311 has been inserted and the bolts applied as heretofore indicated, the entire mechanism will now pivot with relation to tubing 310 by means of the bearing surfaces 313 and 318.

A suitable gear, or pinion 319 is affixed to the top of the tubing 317 and is so adapted as to be engaged by rack 322 which will be activated by a hydraulic cylinder or the like (not shown) fastened to the carrier 300. Thus upon activation, the carrying member 314 may swing back and forth accordingly. The racks of course will be carried by member 323 or the like which can be bolted or otherwise appropriately fastened to the basic carrier 300 by means understood by those skilled in the art.

FIG. 9 illustrates a fork lift truck showing improvements in our apparatus and the use of a double action piston wherein the piston has rods diametrically opposite to each other and the rods can extend and contract at opposite ends of the piston. FIGS. 9–10 should be compared with FIGS. 2–3 to observe the improvements made.

In FIG. 9, the fork lift truck 337, has carrier elements 338, 339. The improved frame elements will be more particularly described in FIGS. 11–12.

In FIG. 11, forks 360, 370, will have shoulders 361, 371, so that the forks can be fastened to carriers 363, 373, but shoulders 361, 371, could be eliminated and the forks could be otherwise fastened to the carriers by use of bolts, welding or the like. Tabs 364, 374, are fastened to the respective carriers and the upper tabs have affixed to them swivel arms 365, 375, and the swivel arms have holes 366, 376.

Frame members 380, 390, have affixed tabs 381, 391, and each tab contains a hole. The frame members also contain holes 382, 392, which cooperate so as to increase or decrease the overall width of the frame 380, 390.

Tabs 364, 374, cooperate with tabs 381, 391, so that the respective holes will align and receive pins 385*a*, 395*a*, and bushings 387 will give rise to less friction and wear caused by swiveling action.

Cylinder 400 contains two rods 401, 402, and each rod has affixed thereto a bracket with hole. Rods 401, 402, will act in the same direction, for example, if rod 401 is moving from left to right then rod 402 is moving from left to right.

The cylinder 400 is fastened to the frame 380, 390 by use of cradle 403 which is fastened to the upper forward surface of frame member 380.

The piston rods are connected to swivel arms 365, 375 by aligning holes at 401, 402 with holes 366, 376, or if alignment is difficult to achieve then arms 384, 394, which contain multiple holes, can be used to assist in alignment.

Note that carriers 363, 373 can have sides like 363*a*, 363*b*, bolted on, also frame member 380 can have brackets 380*a*, 380*b*, bolted on. Note that brackets 380*a*, 380*b*, will slide over the fork lift carrier elements 338, 339, FIG. 9.

In reference to FIG. 10, it can be seen how the double action cylinder operates. Rods 401, 402, should be about one half extended and fastened when the forks are parallel. When rods 401, 402, are moved to the right, the forks assume position 360*b*, 370*b*, and when rods 401, 402, are moved to the left, the forks assume position 360*a*, 370*a*.

FIG. 11*a* displays an alternative fixed frame which cannot be increased or decreased in width as when compared with 380, 390, FIG. 11. This frame could be designed to be a standard carrier attachment to a fork lift.

FIG. 12 illustrates an alternative arrangement for handling rolls of carpet, or the like. Tabs 441, 442 are fastened to frame 440 and the tabs have holes 441*a*, 442*a*. Shoulders 443, 443*a* (not shown), 444, 444*a* are fastened to the frame by means of welding, bolting, or the like, and it is these shoulders which cooperate with the fork lift carrier unit 338, 339, FIG. 9, so as to attach the frame to the fork lift. Bracket 445, containing hole 445*a*, is fastened to frame 440 and clevis 446*a* of cylinder 446 will cooperate with the bracket so as to secure one end of the cylinder.

Carrier 450 has sides 450*a*, 450*b*, which can be fastened by welding, bolting, or the like, and Tab 451, containing hole 451*a*, is likewise fastened to the carrier. Swivel arm 453, containing holes 453*a*, 454, is fastened to tab 452 and the tab is fastened to the carrier. Boom carrier 455 contains shoulders 456, 456*a*, and housing unit 457.

The carpet roll handling unit is assembled as follows: Tabs 441, 442, 451, 452 will cooperate so that pin 453*b* will fasten carrier 450 to frame 440 and form a swivel connection. The pin will be inserted through holes 453*a*, 442*a*, 441*a*, 451*a*, and held in place by conventional methods. Bushings such as 441*b* will be used to reduce friction. Clevis 446*a* will be attached to the frame at 445*a*, in a conventional manner, and clevis 446*b* will be attached to swivel arm 453 at hole 454. Actuation of the piston will cause movement of 446*b* thereby causing arm 453 to move carrier 450. Boom carrier 455 is fastened to carrier 450 by use of shoulders 456, 456*a*. The shoulders 456, 456*a*, can be attached to the carrier 450 by welding or by bolting. End 458*a* of pole 458 is inserted into housing 457 at 457*a*.

FIG. 11*b* illustrates an alternative embodiment of FIG. 11 utilizing a single action piston 400*a*. Frame member 380 has affixed thereto a tab 381*b* which contains a shaft to which clevis 401*a* of cylinder 400*a* is fastened. Tab 391*b* is fastened to carrier 390 and tabs 391*a*, 391*b* cooperate with tabs 374*a* and tabs 381*a*, 381*b* cooperate with tabs 364*a*. Bolts such as 385*b*, 395*b* will pivotally fasten the respective tabs. Swivel arms 365*a*, 375*a* are fastened to carriers 363*a*, 373*a*, respectively by means of a key-keyway, or the like, cooperative with tabs 364*a*, 374*a*. Clamp 402*a*, of cylinder 400*a*, will fasten to swivel arm 375*a* at 376*a* by use of a bolt or other means. Arms 394*a*, 394*b* will secure swivel arm 375*a* to arm 365*a* and since carriers 373*a*, 363*a* are affixed to the respective swivel arms, extension and retraction of the piston arm will cause forks 360*a*, 370*a* to pivotally move in a parallel manner. This alternative embodiment should be compared with FIG. 11.

While the embodiments of this invention shown and described are fully capable of achieving the objects and advantages desired, it is to be understood that such embodiments are for purposes of illustration only and not for purposes of limitation.

I claim:

1. In a fork lift truck with a carriage for vertical movement, apparatus for remote control angulation of load bearing forks comprising: a frame with means for detachably mounting said frame to said fork lift truck carriage, the frame having at least two outwardly projecting elements; a first mounting for attaching a forwardly extending first fork, said first mounting having at least one rearwardly extending bracket to pivotally cooperate with at least one of the outwardly projecting elements of the frame; a second mounting for attaching a forwardly extending second fork, said second mounting having at least one rearwardly extending bracket to pivotally cooperate with at least one of the outwardly projecting elements of the frame; each fork having an arm extending rearwardly to a greater extent than the respective rearwardly extending bracket; a device connected to both rearwardly extending arms; and, means attached to the device wherein the load bearing forks can be turned in equal angular proportions about their own individual pivot axis from a remote location, whereby said forks can be pivoted with a load resting on said pair of forks.

2. The invention of claim 1, wherein the distance between the at least two outwardly projecting elements is adjustable.

3. The invention of claim 1, wherein said frame comprises a pair of frames slidable relative to each other.

4. The invention of claim 3 wherein the means to pivot said forks comprises stop means which contacts said forks during the horizontal sliding of said pair of frames.

* * * * *